US005558625A

United States Patent [19]

McKay

[11] Patent Number: 5,558,625

[45] Date of Patent: Sep. 24, 1996

[54] FOOT MASSAGER APPARATUS

[76] Inventor: Don W. McKay, 149 Dovertree Place SE, Calgary, Alberta, Canada, T2B2K3

[21] Appl. No.: 324,622

[22] Filed: Oct. 18, 1994

[51] Int. Cl.[6] ..... A61H 1/00; A61H 15/00

[52] U.S. Cl. ..... 601/118; 601/27; 601/28; 601/32; 601/122

[58] Field of Search ..... 601/27, 28, 32, 601/118, 122

[56] References Cited

U.S. PATENT DOCUMENTS

| | | | |
|---|---|---|---|
| 1,608,598 | 11/1926 | Heilborn | 601/27 |
| 1,998,197 | 4/1935 | Lang | 601/27 |
| 2,448,797 | 9/1948 | Gustlin | 601/27 |
| 2,604,091 | 7/1952 | Hansen | 601/27 |
| 2,752,915 | 7/1956 | Riblet | 601/118 |
| 4,380,231 | 4/1983 | Rocha | 601/118 |
| 5,251,620 | 10/1993 | Boucher | 601/122 |

*Primary Examiner*—Robert A. Hafer
*Assistant Examiner*—Benjamin Koo

[57] ABSTRACT

A foot massaging apparatus comprising a base having a hollow interior and an opening for allowing access to the interior; an axially rotatable roller coupled to the base and extended across its interior such that it projects from the opening; and a foot rest coupled to the base at a location remote from the interior such that it faces the roller.

1 Claim, 3 Drawing Sheets

FIG 1
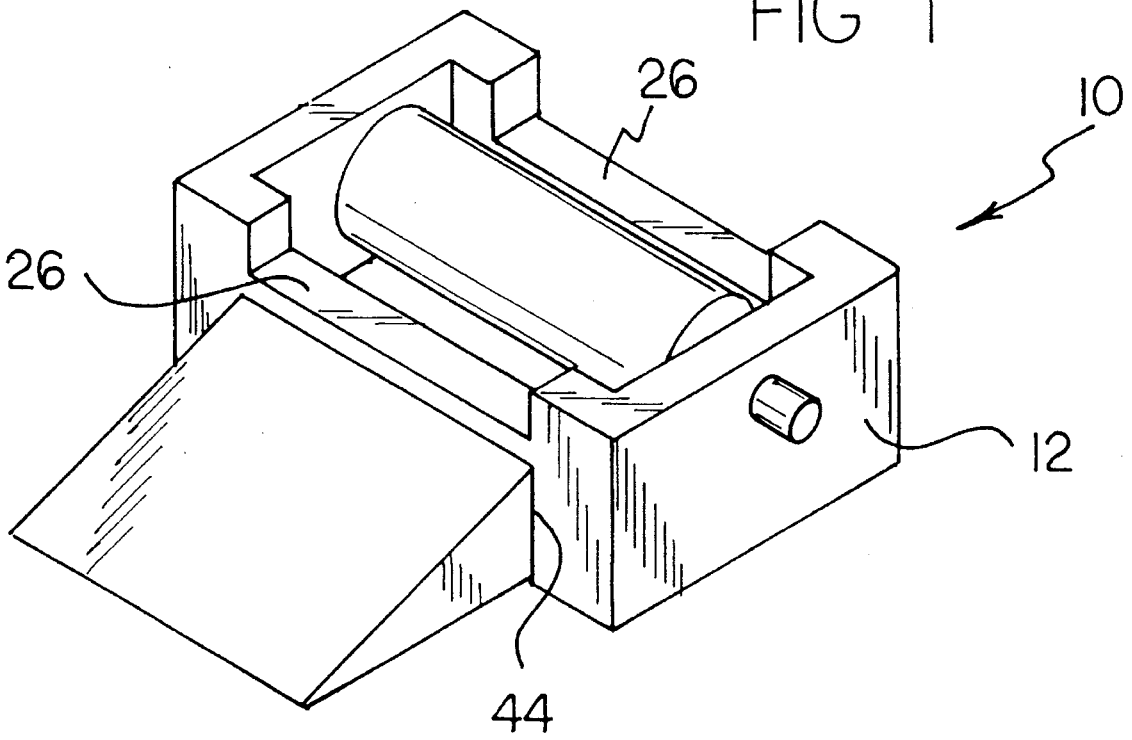
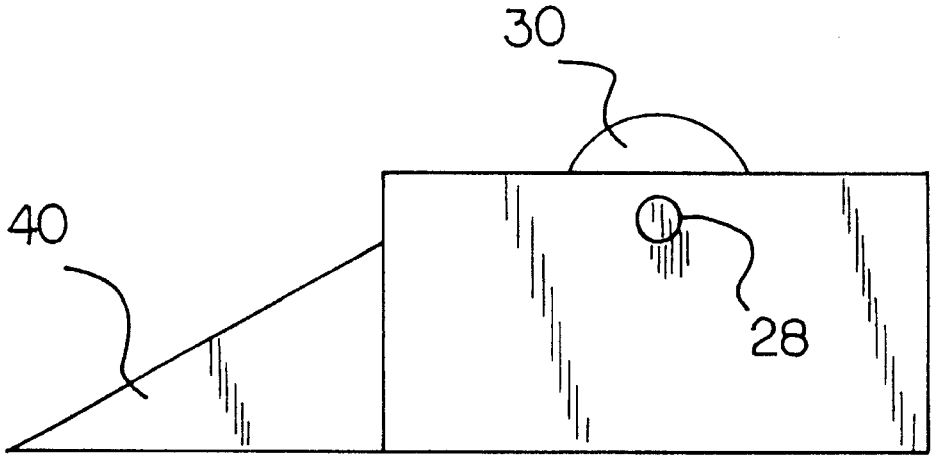
FIG 2

FIG 3
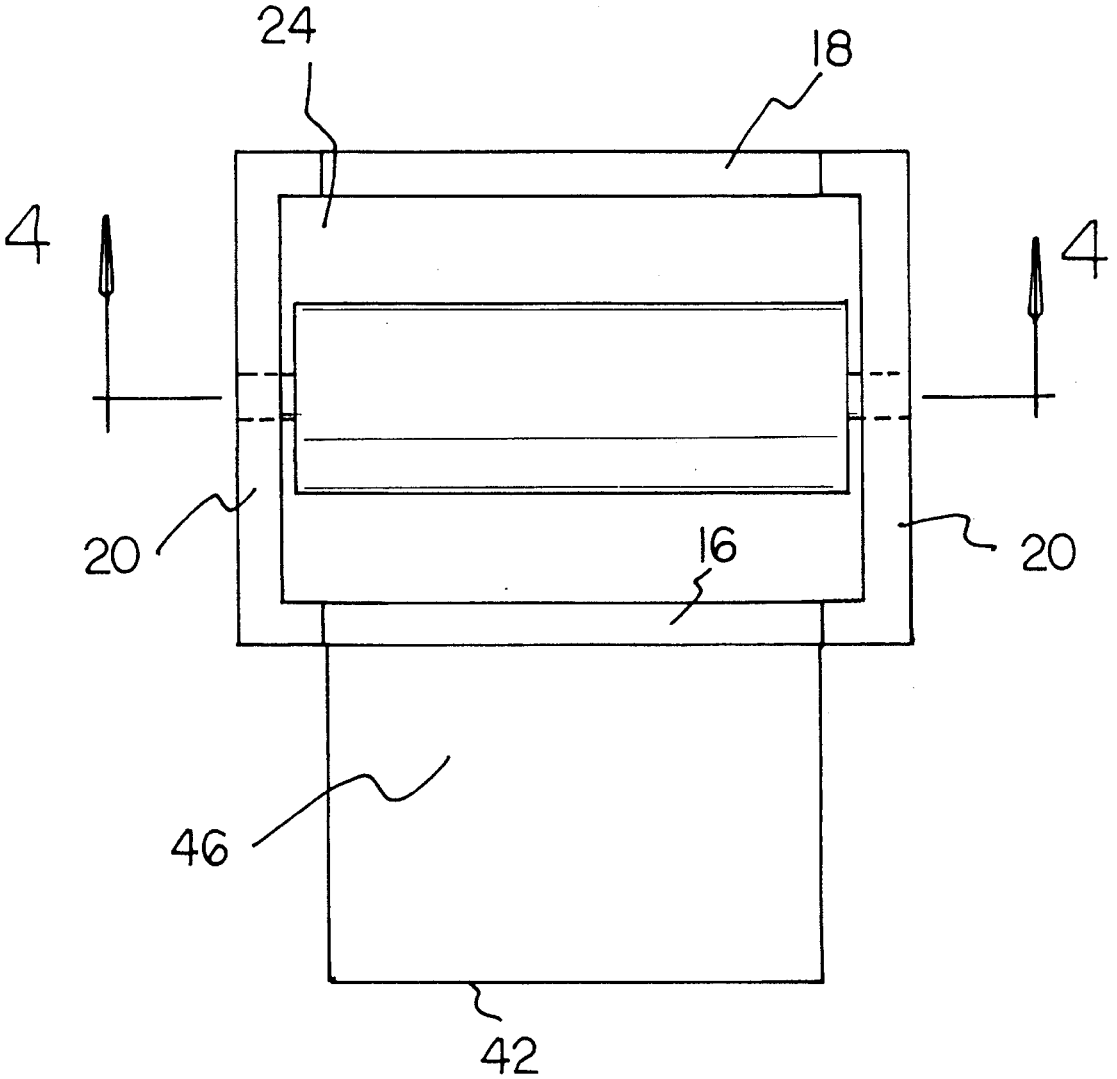
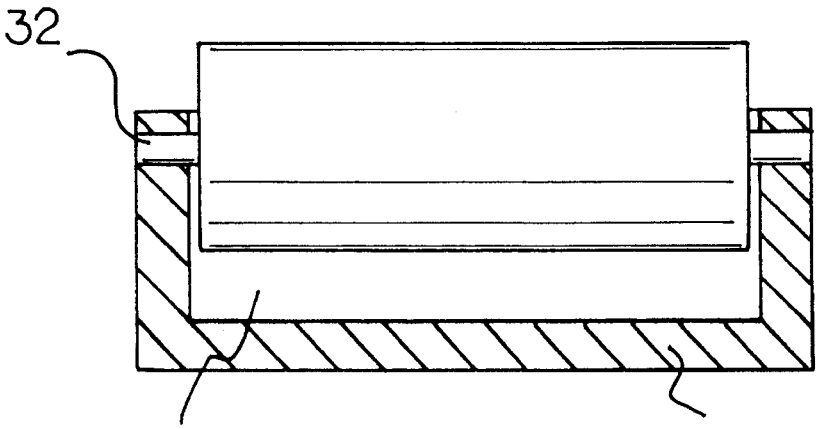
FIG 4

FIG 5
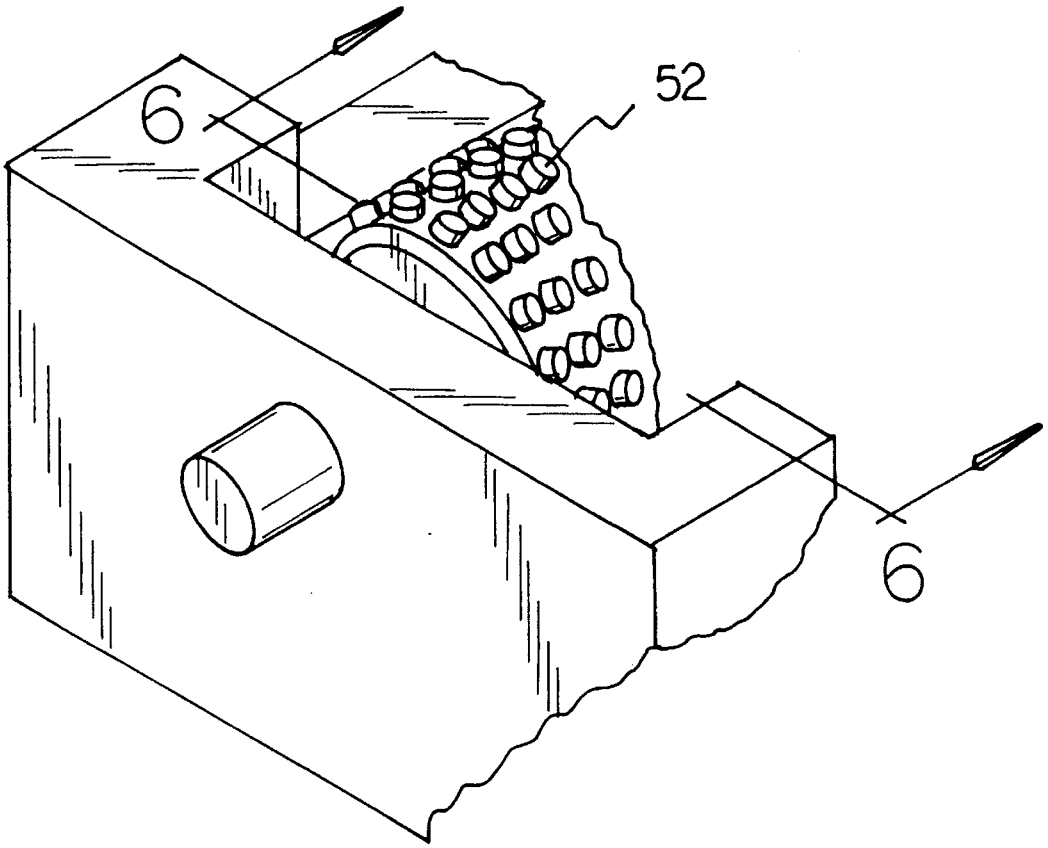
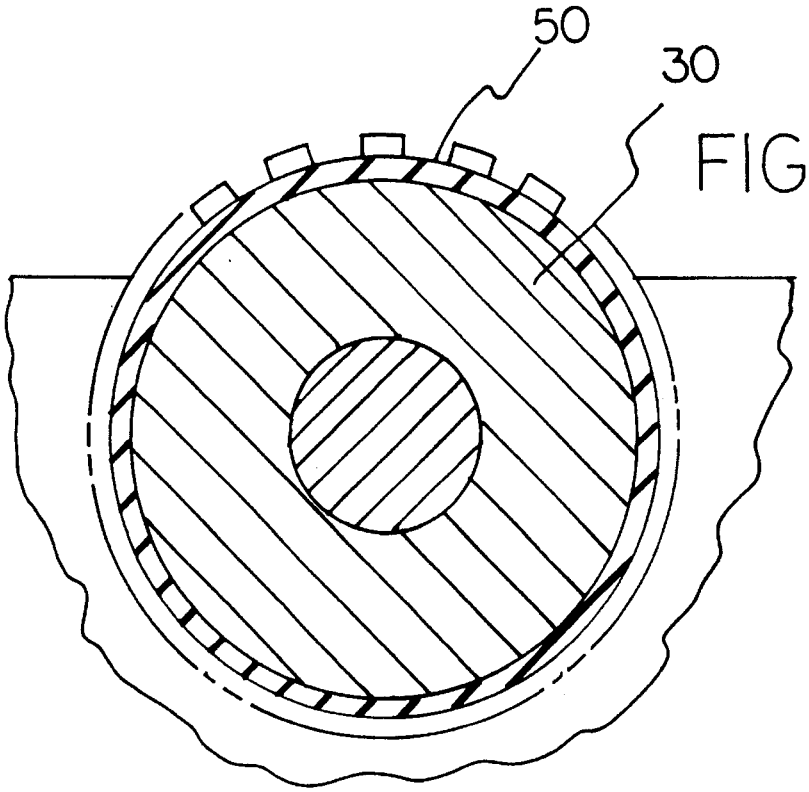
FIG 6

FOOT MASSAGER APPARATUS

BACKGROUND OF THE INVENTION

1. Field of the Invention

The present invention relates to a foot massager apparatus and more particularly pertains to massaging a user's feet with a foot massager apparatus.

2. Description of the Prior Art

The use of foot massaging devices is known in the prior art. More specifically, foot massaging devices heretofore devised and utilized for the purpose of massaging a user's feet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,662,748 to Thurman discloses a foot massage roller. U.S. Pat. No. 4,167,490 to Ruf discloses a roller type massaging apparatus for the feet. U.S. Pat. No. 4,177,803 to Papistas-Scherer et al. discloses a foot exerciser. U.S. Pat. No. 4,205,663 to Fujiwara discloses a device for massaging a sole of a foot. U.S Pat. No. 4,347,838 to McCauley discloses a foot massager. U.S. Pat. No. 5,131,383 to Juarez discloses a foot massage device.

While these devices fulfill their respective, particular objective and requirements, the aforementioned patents do not describe a foot massager apparatus that is simple in design and allows a user to massage his or her feet.

In this respect, the foot massager apparatus according to the present invention substantially departs from the conventional concepts and designs of the prior art, and in doing so provides an apparatus primarily developed for the purpose of massaging a user's feet.

Therefore, it can be appreciated that there exists a continuing need for new and improved foot massager apparatus which can be used for massaging a user's feet. In this regard, the present invention substantially fulfills this need.

SUMMARY OF THE INVENTION

In the view of the foregoing disadvantages inherent in the known types of foot massaging devices now present in the prior art, the present invention provides an improved foot massager apparatus. As such, the general purpose of the present invention, which will be described subsequently in greater detail, is to provide a new and improved foot massager apparatus and method which has all the advantages of the prior art and none of the disadvantages.

To attain this, the present invention essentially comprises, in combination, a rigid box-shaped base having a bottom wall, a periphery formed of a front wall, a rear wall, and opposed side walls extended upward from the bottom wall to define a hollow interior and an opening for allowing access to the interior. The front wall and the rear wall of the base each further include a rectangular notch formed thereon at a location adjacent to the top opening and with the pair of notches positioned such that they are aligned with each other and define an access channel. An axially rotatable roller is included and disposed within the interior of the base and coupled between the side walls thereof such that it projects upwards into the access channel. Lastly, a wedge-shaped rigid foot rest is included and has an outboard edge, an inboard vertical back surface, and a top surface extended therebetween and with the back surface coupled to the front wall such that the top surface extends upwards to meet the access channel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved foot massager apparatus which has all the advantages of the prior art foot massaging devices and none of the disadvantages.

It is another object of the present invention to provide a new and improved foot massager apparatus which may be easily and efficiently manufactured and marketed.

It is a further object of the present invention to provide a new and improved foot massager apparatus which is of durable and reliable construction.

An even further object of the present invention is to provide a new and improved foot massager apparatus which is susceptible of a low cost of manufacture with regard to both materials and labor, and which accordingly is then susceptible of low prices of sale to the consuming public, thereby making such a foot massager apparatus economically available to the buying public.

Still yet another object of the present invention is to provide a new and improved foot massager apparatus which provides in the apparatuses and methods of the prior art some of the advantages thereof, while simultaneously overcoming some of the disadvantages normally associated therewith.

Even still another object of the present invention is to provide a new and improved foot massager apparatus for massaging a user's feet.

Lastly, it is an object of the present invention to provide a new and improved foot massager apparatus comprising a base having a hollow interior and an opening for allowing access to the interior; an axially rotatable roller coupled to the base and extended across its interior such that it projects from the opening; and a foot rest coupled to the base at a location remote from the interior such that it faces the roller.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention.

FIG. 2 is a side elevational view of the preferred embodiment of the present invention.

FIG. 3 is a plan view of the preferred embodiment of the present invention.

FIG. 4 is a cross-sectional view of the present invention taken along line 4—4 of FIG. 3.

FIG. 5 is a perspective view of a portion of an alternate embodiment of the present invention.

FIG. 6 is a cross-sectional view of the alternate embodiment taken along the line 6—6 of FIG. 5.

The same reference numerals refer to the same parts through the various Figures.

DESCRIPTION OF THE PREFERRED EMBODIMENT

With reference now to the drawings, and in particular, to FIG. 1 thereof, the preferred embodiment of the new and improved foot massager apparatus embodying the principles and concepts of the present invention and generally designated by the reference number 10 will be described.

Specifically, the present invention essentially includes three major components. The major components are the base, roller, and foot rest. These components are interrelated to perform the intended function of massaging a user's feet.

More specifically, it will be noted in the various Figures that the first major component is the base 12. The base is box-shaped in structure. It is formed of a rigid material such as plastic or metal. The base has a bottom wall 14 and a periphery formed therearound. The periphery includes a front wall 16, a rear wall 18, and opposed side walls 20. Each of the side walls 20 includes an upper edge. The periphery is extended upwards from the bottom wall to define a hollow interior 22 and an opening 24 for allowing access to the interior. The front wall and the rear wall of the base each include a rectangular notch 26 formed thereon at a location adjacent to the top opening. The pair of notches, each of which has an upper edge, are positioned such that they are aligned with each other and define an access channel. The side walls of the base also include a mounting hole disposed thereon. The mounting holes of the side walls are coaxially aligned.

The second major component is the roller 30. The roller is generally cylindrical in shape. It is formed of a rigid material such as metal or plastic. The roller has a pair of opposed cylindrical pegs 32 extended axially outwards from its ends. The pegs are disposed within the mounting holes of the base to secure the roller within the base for axial rotation therein. When secured within the mounting holes, the roller projects upwards into the access channel between the slots.

The third major component is the footrest 40. The footrest is wedge-shaped in structure. It is formed of a rigid material such as metal or plastic. The footrest has an outboard edge 42, an inboard vertical back surface 44, and a top surface 46 extended upwards at an acute angle from the outboard edge to the back surface. The back surface of the wedge is removably coupled to the back wall such that it extends upwards to meet the access channel.

A second embodiment of the present invention is shown in FIG. 5 and 6. This embodiment includes substantially all of the components of the present invention further including a removable pad 50 disposed about the roller. The pad is formed of rubber or similar elastomeric material. A plurality of cylindrical nubs 52 arranged in linear sequence across the pad extend outwards to assist in massaging.

To operate the present invention, a user places his or her feet on the foot rest such that they extend upon the roller. The user then actuates the roller for massaging his feet. The user may actuate the roller with one foot while massaging the other foot. This actuation should be performed for about 10–20 minutes about 2 or 3 times a day. In the preferred embodiment, the roller has an axial length of about 13 inches. The width of the base as measured between its side walls is about 17¾ inches. The base has a height of about 8 inches. Each side wall of the base has a mounting holes formed thereon for receiving the roller therein. In the preferred embodiment, cylindrical pegs are axially extended from the roller with each peg inserted within a separate hole on a side wall. An alternate embodiment of the present invention utilizes a removable rubber pad positionable on the roller. The pad has a nubbed surface for massaging the feet and stimulating the pressure points. The present invention is especially useful in an office application. The present invention may be formed in various colors. Surface ornamentation may be disposed upon the present invention to enhance its appearance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A foot massaging apparatus for massaging a user's feet comprising, in combination:

a rigid box-shaped base having a bottom wall, a periphery formed of a front wall, a rear wall, and opposed side walls extended upward from the bottom wall, each of the side walls of the base including a mounting hole disposed thereon with the mounting holes of the side walls being coaxially aligned, each of the opposed side walls having an upper edge, the front wall, rear wall and opposed side walls defining a hollow interior and an opening for allowing access to the interior with the front wall and the rear wall each further having a rectangular notch formed thereon at a location adjacent to the top opening, each of the rectangular notches having an upper edge, and with the pair of notches positioned such that they are aligned with each other and define an access channel, wherein the upper edges of the notches are at an elevation below the elevation of the upper edges of the opposed side walls;

an axially rotatable roller disposed within the interior and having a pair of opposed cylindrical pegs extended radially outward and adapted to be disposed within the mounting holes of the base for affording the axial rotation thereof thereby allowing the user to actuate the roller with one foot while massaging the other foot, the roller being situated so as to project upwards into the access channel, the roller further including a removable pad disposed about the roller and having a plurality of nubs extending therefrom for massaging; and a wedge-shaped rigid foot rest having an outboard edge, an inboard vertical back surface, and a top surface extended therebetween and with the back surface coupled to the front wall such that the top surface extends angularly upwards to meet the access channel.

* * * * *